United States Patent [19]

Lee et al.

[11] 4,427,252

[45] Jan. 24, 1984

[54] ELECTRICAL CONNECTOR

[75] Inventors: Noel Lee, Daly City; Andrew L. Choy, San Francisco, both of Calif.

[73] Assignee: Monster Cable Products, Inc., San Francisco, Calif.

[21] Appl. No.: 274,767

[22] Filed: Jun. 18, 1981

[51] Int. Cl.[3] ..... H01R 4/30

[52] U.S. Cl. ..... 339/89 R; 339/263 R

[58] Field of Search ..... 339/32 R, 32 M, 33, 339/89 R, 89 C, 89 M, 252 R, 252 P, 263 R

[56] References Cited

U.S. PATENT DOCUMENTS

| | | | |
|---|---|---|---|
| 597,002 | 1/1898 | Jewell . | |
| 1,103,544 | 7/1914 | Smith . | |
| 1,671,540 | 5/1928 | Monteil | 339/252 P X |
| 1,715,624 | 6/1929 | Reisz . | |
| 2,306,821 | 12/1942 | Markey . | |
| 2,377,912 | 6/1945 | Way | 339/252 P |
| 2,464,565 | 3/1949 | Evans et al. . | |
| 2,851,669 | 9/1958 | Koch . | |
| 3,066,272 | 11/1962 | Quackenbush | 339/89 X |
| 3,693,140 | 9/1972 | Nijman . | |
| 3,798,586 | 3/1974 | Huska . | |
| 4,138,182 | 2/1979 | Muratsuka | 339/89 M |

FOREIGN PATENT DOCUMENTS

| | | | |
|---|---|---|---|
| 1456719 | 12/1966 | France | 339/252 P |
| 1088235 | 10/1967 | United Kingdom | 339/252 P |

*Primary Examiner*—Fred Silverberg

*Attorney, Agent, or Firm*—Warren B. Kice

[57] ABSTRACT

An electrical connector for effecting connection to 'banana' type sockets includes a connector body having an axially elongated male pin extending from one end thereof. A captive, internally threaded collar is located at the proximate end of the pin and is used to threadedly engage the external threads of a mating socket. The other end of the connector body includes an internally threaded bore for receiving a threaded terminal fastener that includes a head portion for securing bifurcated terminal lugs between the end of the connector body and the head of the terminal fastener. A flat side surface is formed on the head of the terminal fastener for engaging the bent free ends of bifurcated terminal lugs. The terminal fastener also includes an axially aligned bore for receiving a male banana-type pin and a diametrically aligned bore for receiving a solid or a stranded core wire so that the wire can be secured between the head of the terminal fastener and the end of the connector body.

13 Claims, 9 Drawing Figures

ELECTRICAL CONNECTOR

BACKGROUND OF THE INVENTION

The present invention relates to electrical connectors and, more particularly, to electrical connectors for improving the connection between a current carrying wire and a 'banana' type connector and especially between large-sized wire cables used in high power audio systems and the 'banana' type sockets found on many loudspeakers and amplifiers used in audio systems.

In entertainment-type audio systems, including systems used in the home, the loudspeakers have been traditionally connected to the audio amplifier through loudspeaker wires with the actual interconnection between the end of the wires and the loudspeaker and the amplifier effected through various types of electrical connectors. Historically, these connectors have included a 'banana' type jack and socket arrangement in which the socket includes an externally threaded sleeve having a smooth internal bore that receives the male connecting pin of the cooperating jack. The pin usually is designed to resiliently expand in the radial direction to resiliently engage the interior bore of the threaded sleeve. The 'banana' type sockets have generally been satisfactory for their intended purpose since their 'plug-in' design makes them convenient to use and they provide a relatively good electrical connection. In recent years, however, there has been a tendency in home and commercial audio entertainment systems to vastly increase the power level delivered to the loudspeakers. These higher power systems have included amplifiers adapted to provide several hundred watts of power to loudspeakers capable of handling those power levels. It has been recognized in these powerful systems that losses can be encountered in the traditionally used loudspeaker wire. In response to this realization, these higher power systems have used much larger capacity cables to deliver the audio energy to the loudspeakers. However, the traditional interconnection between the larger capacity speaker wire and the loudspeaker and/or amplifiers is still generally limited to the banana type plug-in-jack arrangement. These types of sockets can also introduce losses into the system, in part, because the quality of the electrical connection between the male jack and the female socket depends upon the radial resilience of the male pin. Accordingly, there is a need for a more audio-power efficiency interconnection between high capacity speaker wires used in high power audio systems and the banana-type sockets traditionally used on the vast majority of existing loudspeakers and amplifiers.

SUMMARY OF THE INVENTION

Accordingly, it is an object of the present invention, among others, to provide an electrical connector that efficiently effects connection between traditional banana-type sockets and an audio power cable in which losses attributable to the design of the banana-type pin/-socket arrangement are minimized.

It is also another object of the present invention to provide a connector for efficiently connecting a loudspeaker wire to a traditional banana-type socket in which losses attributable to the design of the banana-type pin and socket arrangement are minimized and which the connect/disconnect convenience of the banana pin-type socket is largely retained.

In accordance with these objects, and others, the present invention provides an electrical connector having a connector body with a male connector pin extending axially from one end thereof. The male connector pin is provided with at least one diametric slot to provide the pin with a measure of radial resilience and also includes a hollow bore for receiving a solid pin connector. A threaded collar is rotatably mounted at the proximate end of the connector pin for securing the electrical connector to the threaded banana-type socket. The connector body includes a smooth bore for receiving a pin-type connector and an internally threaded bore for receiving a threaded terminal fastener that includes a head portion for constraining a bifurcated terminal lug between the head of the terminal fastener and the end of the connector body. The terminal fastener includes a flat side surface for engaging the bent ends of the bifurcated lug as an aid in preventing unintentional loosening of the terminal. The terminal fastener also includes an axially aligned bore for receiving a male banana-type connector and a diametrically aligned bore for receiving and constraining a stranded or solid-core wire between the head of the terminal fastener and the end face of the connector body.

The disclosed connector facilitates effective electrical connection between loudspeakers, amplifiers, and similar apparatus having banana-type sockets and loudspeaker cables designed to carry high power levels without compromising the convenient connect/disconnect feature of the banana type plug.

BRIEF DESCRIPTION OF THE DRAWINGS

The above description as well as further objects, features, and advantages of the present invention will be more fully understood by reference to the following description of presently preferred but nonetheless illustrative embodiment in accordance with the present invention, when taken in connection with the accompanying drawings wherein.

DESCRIPTION OF THE PREFERRED EMBODIMENT

Figure 1:
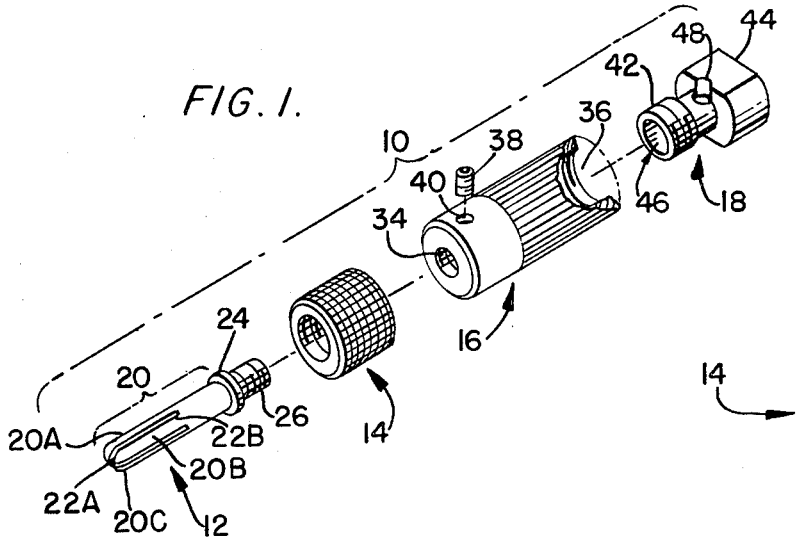
FIG. 1 is an exploded perspective view of an exemplary electical connector in accordance with the present invention.
Figure 1A:
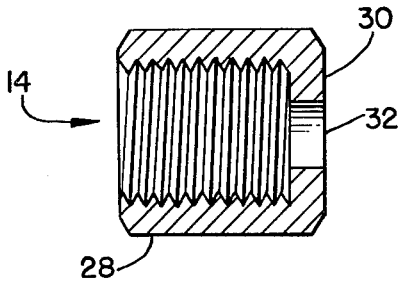
FIG. 1A is an expanded side view, in cross section, of an internally threaded collar illustrated in FIG. 1.
Figure 2:
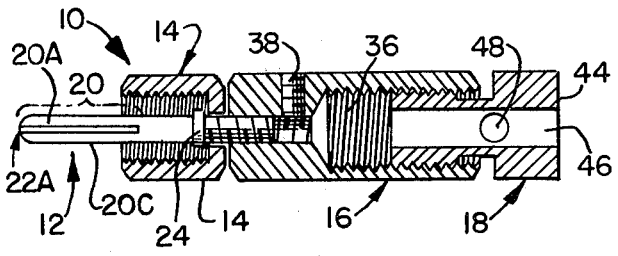
FIG. 2 is an assembled side view, in cross section, of the electrical connector shown in FIG. 1.

A preferred embodiment of an electrical connector in accordance with the present invention is shown in exploded perspective in FIG. 1 and in assembled cross section in FIG. 2 and is generally designed therein by the reference character 10. The connector 10 includes an axially extending male pin 12, a securing collar 14, a connector body 16, and a terminal securing nut or fastener 18. The pin 12 includes a contact portion 20 that has two mutually perpendicular, diametrically aligned slots 22A and 22B formed therein that divides the contact portion 20 into contact arm quadrants of which quadrants 20A and 20B are shown in FIG. 1 and quadrants 20A and 20C are shown in FIG. 2. The slots 22A and 22B provide the contact portion 20 with a measure of radially outwardly resilience as is known in the art. A flange 24 is located at the base of the contact portion 20 and an externally threaded, reduced diameter mounting stud 26 extends axially rearward of the flange 24. The stud end of the pin 12 includes an axially aligned hollow bore 27 (FIG. 2A) for receiving a solid pin connector as described more fully below. The securing collar 14 is mounted at the stud end of the pin 12 and includes (FIG. 1A) an internally threaded cylindrical portion 28 and an end wall 30 that includes a concentric hole or opening 32 through which the mounting stud 26 passes with a clearance fit therebetween.

The connector body 16 is a cylindrical, axially elongated member having a concentric, internally threaded bore 34 that receives the mounting stud 26 and a larger internally threaded bore 36 that receives the terminal fastener 18 as described more fully below. As shown in FIG. 2, the mounting stud 26 is threaded into the bore 34 with the securing collar 14 captured between the flange 24 and the adjacent end face of the connector body 16. The spacing between the flange 24 and the adjacent end face of the body 20 is adjusted so that the collar 14 is freely rotatable. A set screw 38 is located in the appropriately threaded bore 40 and used to lock a solid pin connector into the bore 27 of the pin 12 as described below.

Figure 5A:
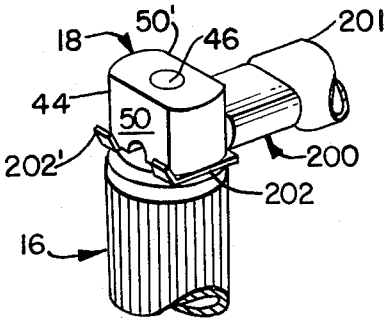
FIG. 5A is a partial perspective view of the connector of FIG. 2 showing a bifurcated wire terminal connected thereto.
Figure 5B:
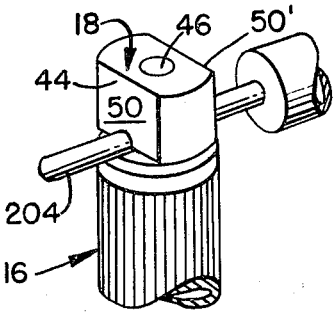
FIG. 5B is a partial perspective view of the connector of FIG. 2, similar to that of FIG. 4A, showing a wire connected thereto.

The terminal fastener 18 includes an externally threaded portion 42 that is threadedly received within the threaded bore 36 and a head portion 44 adapted to engage the end face of the connector body 16 opposite from the pin 12 so as to constrain a terminal therebetween. The terminal fastener 18 includes an axially aligned through bore 46 dimensioned to receive a banana-type connector and a diametrically aligned bore 48 for receiving a solid or stranded core wire. As shown in FIGS. 5A and 5B, the terminal fastener 18 includes two parallel chordal flats 50 and 50′ that assist in securing a bifurcated wire lug to the connector 10 as described more fully below.

The electrical connector 10 shown in FIGS. 1–2 is adapted to connect a current carrying wire, especially a larger diameter speaker wire typically used in high power audio entertainment systems, to a loudspeaker of the type having a standard banana-type socket 100 (FIG. 3) that typically includes a hollow tubular post 102 having a smooth internal bore 104 and external threads 106 and a binding nut 108 that threadedly engages the external threads 106 on the tubular member 102.

Figure 4:
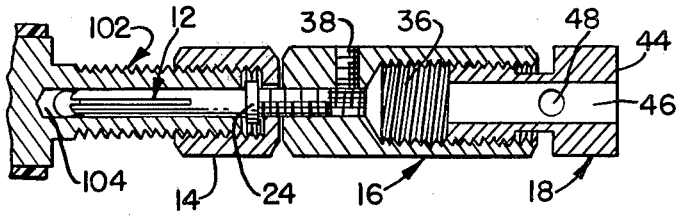
FIG. 4 is a side view, in cross section, of an electrical connector of the type shown in FIGS. 1 and 2 connected to a banana-type socket of the type shown in FIG. 3.
Figure 3:
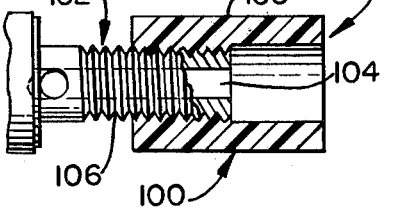
FIG. 3 is a side view, in cross section, of a conventional banana-type socket suitable for use with the connector shown in FIGS. 1 and 2.

In order to effect connection between the electrical connector 10 of FIGS. 1 and 2 and the standard banana-type socket 100 shown in FIG. 3, the binding nut 108 is removed from the threaded post 102 and discarded. As shown in FIG. 4, the pin 12 of the electrical connector 10 is inserted into the smooth internal bore 104 of the post 102 while the collar 14 is rotated to engage the external threads 106 of the post 102 until the flange 24 on the pin 12 abuts the distal end of the post 102. As can be appreciated by those skilled in the art, the combination of the resilient pin 12 and the securing collar 14 permits an enhanced mechanical connection and an enhanced electrical connection with the threaded post 102 by virtue of the vastly increased electrical contact area. In order to facilitate the manual rotation of the collar 14 relative to the threaded post 102, the external surface of the collar 14 may be knurled or striated as shown in FIG. 1. A preferred knurling pattern includes recurring axially aligned "V" grooves equi-spaced about the circumference of the collar 14.

Figure 2A:
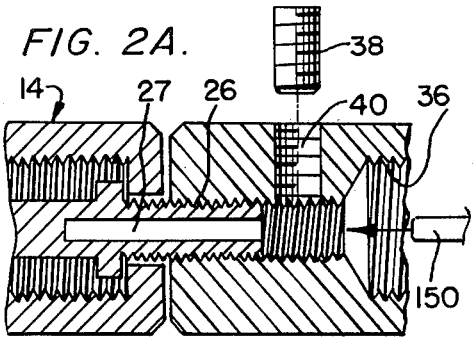
FIG. 2A is an enlarged partial view of the connector shown in FIG. 2.

The interconnection between the power carrying wire and the other end of the electrical connector 10 may be effected in one of several fashions as shown in FIGS. 2A and 5A–5C. In the arrangement of FIG. 2A, a solid pin-type connector 150 (typically having a 1.8 mm diameter) is inserted into the bore 27 at the stud end of the pin 12 and secured in place by appropriate adjustment of the set screw 38. The current carrying wire (not shown) is secured to the connector 150 in a conventional manner.

In FIG. 5A, a bifurcated terminal lug 200 is crimped or otherwise connected to the conductor portion of an insulated power carrying wire 201. The lug 200, as is conventional in the art, includes spaced parallel legs 202 and 202′ with the distal ends of the legs inclined at an angle relative to the remaining portion of the legs. The terminal lug 200 is constrained between the head 44 of the threaded fastener 18 and the connector body 16. The upturned distal ends of the lug legs 202 and 202′ are aligned on one of the flat side faces 50 or 50′ of the threaded fastener 18 to permit the lug 200 itself to be used as a lever or crank; that is, the upturned distal end of one of the legs 202 or 202′ bears against one of the flats 50 or 50′ while the lug 200 is manually grasped and rotated to thus cause the terminal fastener 18 and the lug 200 to tighten against the end of the connector body 16.

Figure 5C:
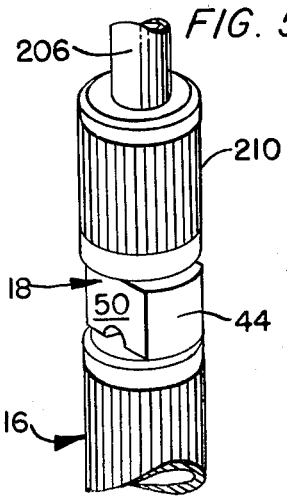
FIG. 5C is a perspective view of the connector of FIG. 2, similar to that of FIGS. 5A and 5B, having a "piggyback" connector attached thereto.

In FIG. 5B, the conductive core 204 of a wire, either a solid core or a stranded core wire, has been passed through the diametrically aligned hole 48 in the terminal fastener 18 and constrained between the head portion 44 and the end face of the conductor body 16. In FIG. 5C another male type banana connector 210 which is connected to a power carrying wire 206 has its pin portion (not shown) inserted into the axially aligned bore 46 in the terminal fastener 18 to effect a "piggyback" interconnection. This connector 210 can be of a conventional design or can be identical to the connector 10 of the present invention.

The electrical connector 10 of the present invention thus permits a more electrically efficient interconnection between amplifiers and loudspeakers of the type that have traditional banana-type socket interconnections and the large-size, high power carrying loud speaker wires that have recently come into use. As can be well appreciated, in addition to providing a more efficient electrical interconnection, the jack and plug type convenience of the banana-type socket is largely retained.

As can be appreciated by those skilled in the art, various changes and modifications may be made to the disclosed embodiment of the electrical connector without departing from the spirit and scope of the invention as recited in the appended claims and their legal equivalent.

What is claimed is:

1. An electrical connector for connection to a post type connector defined by an externally threaded tubular member having a smooth pin-receiving internal bore, said electrical connector comprising:

a male pin connected to the end of a connector body;

an internally threaded collar mounted on said pin for free rotation, said collar being threadedly engagable with the external threads of the post-type connector;

said connector body, at the end thereof remote from said pin, having a threaded bore therein; and a terminal fastener having a threaded portion for threadedly engaging said threaded bore of said connector body and a head portion for securing an electrical terminal between the said head portion and the end of the connector body, said terminal fastener including an axially directed bore for receiving a pin-type banana connector and a diametrically aligned bore for receiving an electrical conductor for detachably securing the conductor between said head and the end of the connector body.

2. The electrical connector claimed in claim 1 wherein:

said male pin includes at least one longitudinally extending slot to define first and second contact portions that are resiliently urgable outwardly from one another when inserted into the pin receiving bore of a post-type connector.

3. The electrical connector claimed in claim 1 wherein;

said male pin includes an enlarged diameter flange and a mounting stud axially extending from said flange, said stud received within a stud-receiving bore formed in said connector body, said flange spaced a selected distance from the pin end of the connector body, said collar having an axially extending cylindrical portion and an end wall having a bore therein, said collar mounted on said stud intermediate said pin end of said connector and said flange.

4. The electrical connector claimed in claim 1 wherein:

said male pin includes an axial bore therein having at least one end opening into the threaded bore of said connector body, said male pin axial bore adapted to receive a connector pin therein.

5. The electrical connector claimed in claim 4 further comprising:

a threaded screw located in a threaded bore for securing a connector pin in said male pin axial bore.

6. The electrical connector claimed in claim 1 wherein:

said terminal fastener includes at least one flat side surface for engaging inclined distal ends of a bifurcated terminal lug.

7. An electrical connector for connection to a post-type connector defined by an externally threaded tubular member having a smooth pin-receiving internal bore, said electrical connector comprising:

a male pin connected to the end of a connector body;

said connector body, at the end thereof remote from said pin, having a threaded bore therein;

a terminal fastener having a threaded portion for threadedly engaging said threaded bore of said connector body and a head portion for securing an electrical terminal between said head portion and the end of said connector body, said head portion including at least one flat side surface for engaging inclined distal ends of a bifurcated terminal lug;

an internally threaded collar mounted at the proximate end of said pin for free rotation, said collar being threadedly engagable with the external threads of the post-type connector; and said male pin including an enlarged diameter flange and a mounting stud axially extending from said flange, said stud received within a stud-receiving bore formed in said connector body, said flange spaced a selected distance from the pin end of the connector body, said collar having an axially extending cylindrical portion and an end wall having a bore therein, said collar mounted on said stud intermediate the corresponding end of said connector body and said flange.

8. The electrical connector claimed in claim 7 wherein:

said male pin includes at least one longitudinally extending slot to define first and second contact portions that are resiliently urgable outwardly from one another when inserted into the pin receiving bore of a post-type connector.

9. The electrical connector claimed in claim 7 wherein:

said male pin includes an axial bore therein having at least one end opening into the thread bore of said connector body, said male pin axial bore adapted to receive a connector pin therein.

10. The electrical connector claimed in claim 9 further comprising;

a threaded screw located in a threaded bore for securing a connector pin in said male pin axial bore.

11. An electrical connector for connection to a post type connector defined by an externally threaded tubular member having a smooth pin-receiving internal bore, said electrical connector comprising:

a male pin connected to the end of a connector body;

an internally threaded collar mounted at the proximate end of said pin for free rotation, said collar being threadedly engagable with the external threads of the post-type connector;

said connector body, at the end thereof remote from said pin, having a bore formed therein;

said male pin including an axial bore therein which, together with the bore of said connector body, is adapted to receive a connector pin therein; and a threaded screw located in a threaded bore for securing said connector pin in said male pin axial bore.

12. An electrical connector for connection to a post type connector defined by an externally threaded tubular member having a smooth pin-receiving internal bore, said electrical connector comprising:

a male pin connected to the end of a connector body;

an internally threaded collar mounted at the proximate end of said pin for free rotation, said collar being threadedly engagable with the external threads of the post-type connector;

said connector body, at the end thereof remote from said pin, having a bore formed therein;

said male pin including an axial bore therein which, together with the bore of said connector body, is adapted to receive a connector pin therein, and said male pin further including an enlarged diameter flange and a mounting stud axially extending from said flange, said stud received within a stud-receiving bore formed in said connector body, said flange spaced a selected distance from the pin end of the connector body, said collar having an axially extending cylindrical portion and an end wall having a bore therein, said collar mounted on said stud intermediate said pin end of said connector and said flange.

13. An electrical connector for connection to a post type connector defined by an externally threaded tubular member having a smooth pin-receiving internal bore, said electrical connector comprising:

a male pin connected to the end of a connector body;

an internally threaded collar mounted at the proximate end of said pin for free rotation, said collar being threadedly engagable with the external threads of the post-type connector;

said connector body, at the end thereof remote from said pin, having a bore formed therein;

said male pin including an axial bore therein which, together with the bore of said connector body, is adapted to receive a connector pin therein; and said male pin further including at least one longitudinally extending slot to define first and second contact portions that are resiliently urgable outwardly from one another when inserted into the pin receiving bore of a post-type connector.

* * * * *